US010301559B2

(12) United States Patent
Oprins et al.

(10) Patent No.: US 10,301,559 B2
(45) Date of Patent: May 28, 2019

(54) METHOD FOR CONVERTING A HIGH-BOILING HYDROCARBON FEEDSTOCK INTO LIGHTER BOILING HYDROCARBON PRODUCTS

(71) Applicants: Saudi Basic Industries Corporation, Riyadh (SA); SABIC Global Technologies, B.V., PX Bergen Op Zoom (NL)

(72) Inventors: Arno Johannes Maria Oprins, Geleen (NL); Ravichander Narayanaswamy, Bangalore (IN); Andrew Mark Ward, Wilton Centre Wiltshire (GB)

(73) Assignees: SAUDI BASIC INDUSTRIES CORPORATION, Riyadh (SA); SABIC GLOBAL TECHNOLOGIES B.V., Bergen Op Zoom (NL)

( * ) Notice: Subject to any disclaimer, the term of this patent is extended or adjusted under 35 U.S.C. 154(b) by 0 days.

(21) Appl. No.: 15/120,882

(22) PCT Filed: Dec. 23, 2014

(86) PCT No.: PCT/EP2014/079207
§ 371 (c)(1),
(2) Date: Aug. 23, 2016

(87) PCT Pub. No.: WO2015/128038
PCT Pub. Date: Sep. 3, 2015

(65) Prior Publication Data

US 2017/0121613 A1 May 4, 2017

(30) Foreign Application Priority Data

Feb. 25, 2014 (EP) ..... 14156630

(51) Int. Cl.
*C10G 65/00* (2006.01)
*C10G 9/36* (2006.01)
(Continued)

(52) U.S. Cl.
CPC ..... *C10G 65/00* (2013.01); *C10G 9/36* (2013.01); *C10G 47/00* (2013.01); *C10G 65/10* (2013.01);
(Continued)

(58) Field of Classification Search
None
See application file for complete search history.

(56) References Cited

U.S. PATENT DOCUMENTS 2,885,346 A * 5/1959 Kirshenbaum ..... C10G 47/04 208/110
3,287,252 A * 11/1966 Young ..... C10G 47/16 208/110

(Continued)

FOREIGN PATENT DOCUMENTS

GB 1020595 A 2/1966
GB 1161725 A 10/1967

(Continued)

OTHER PUBLICATIONS

International Search Report and Written Opinion of International Application No. PCT/EP2014/079207; 12 pages; dated Mar. 20, 2015.

(Continued)

*Primary Examiner* — Tam M Nguyen
(74) *Attorney, Agent, or Firm* — Norton Rose Fulbright US LLP

(57) ABSTRACT

A process for converting hydrocarbons originating from refinery operations such as atmospheric distillation unit or a fluid catalytic cracking unit (FCC), into lighter boiling
(Continued)

hydrocracked hydrocarbons having a boiling point lower than naphthalene and lower.

11 Claims, 2 Drawing Sheets

(51) Int. Cl.
*C10G 47/00* (2006.01)
*C10G 65/10* (2006.01)
*C10G 65/12* (2006.01)

(52) U.S. Cl.
CPC ..... *C10G 65/12* (2013.01); *C10G 2400/28* (2013.01); *C10G 2400/30* (2013.01)

(56) References Cited

U.S. PATENT DOCUMENTS 3,317,419 A 5/1967 Fortman
3,360,456 A 12/1967 Kosiba et al.
3,364,132 A * 1/1968 Schoenfeld ..... C10G 25/03 208/139
3,402,121 A * 9/1968 Hallman ..... C10G 47/36 208/108
3,505,205 A * 4/1970 Sebulsky ..... C10G 47/14 208/112
3,649,518 A * 3/1972 Watkins ..... C10G 47/00 208/100
3,660,270 A 5/1972 Mason
3,691,058 A * 9/1972 Hammer et al. ..... C10G 47/00 208/104
3,758,628 A * 9/1973 Strickland ..... C10G 11/18 208/58
4,082,647 A * 4/1978 Hutchings ..... C10G 65/00 208/18
4,137,147 A 1/1979 Franck et al.
4,390,413 A * 6/1983 O'Rear ..... B01J 29/40 208/100
4,574,043 A * 3/1986 Chester ..... B01J 29/7484 208/111.35
5,180,868 A * 1/1993 Baker ..... C10G 69/02 208/49
5,603,824 A 2/1997 Kyan et al.
6,153,087 A 11/2000 Bigeard et al.
6,270,654 B1 8/2001 Colyar et al.
7,214,308 B2 5/2007 Colyar
7,704,377 B2 4/2010 Duddy et al.
7,938,952 B2 5/2011 Colyar et al.
8,926,824 B2 1/2015 Morel
9,005,430 B2 4/2015 Fournier et al.
9,840,674 B2 12/2017 Weiss et al.
2003/0221990 A1 12/2003 Yoon et al.
2006/0014995 A1* 1/2006 Ramachandran ..... C10G 45/52 585/700
2007/0112237 A1 5/2007 Lee et al.
2007/0156003 A1* 7/2007 Furukawa ..... C07C 7/171 585/858
2008/0047872 A1* 2/2008 Iaccino ..... C07C 2/76 208/66
2008/0093262 A1 4/2008 Gragnani et al.
2009/0050523 A1 2/2009 Halsey
2012/0125811 A1 5/2012 Bridges et al.
2012/0125812 A1 5/2012 Bridges et al.
2012/0125813 A1 5/2012 Bridges et al.
2014/0299515 A1 10/2014 Weiss et al.
2015/0368570 A1* 12/2015 Beech, Jr. ..... C10G 49/00 208/68
2016/0115403 A1* 4/2016 Macris ..... C10G 67/02 208/59
2016/0122666 A1 5/2016 Weiss et al.

FOREIGN PATENT DOCUMENTS

JP 2010-235670 10/2010
JP 2012-503071 2/2012
JP 2012-503072 2/2012
WO 2007055488 A1 5/2007
WO 2008043066 A2 4/2008
WO WO 2016/146326 9/2016

OTHER PUBLICATIONS

Office Action issued in Corresponding Japanese Patent Application No. 2016-553871, dated Jan. 10, 2019.

* cited by examiner

METHOD FOR CONVERTING A HIGH-BOILING HYDROCARBON FEEDSTOCK INTO LIGHTER BOILING HYDROCARBON PRODUCTS

CROSS-REFERENCE TO RELATED APPLICATIONS

This application is a national phase under 35 U.S.C. § 371 of International Application No. PCT/EP2014/079207, filed Dec. 23, 2014, which claims the benefit of priority to European Patent Application No. 14156630.7 filed Feb. 25, 2014, the entire contents of each of which are hereby incorporated by reference in their entirety.

TECHNICAL FIELD AND BACKGROUND OF THE INVENTION

The present invention relates to a process for converting a high-boiling hydrocarbon feedstock into lighter boiling hydrocarbon products. More in detail, the present invention relates to a process for converting hydrocarbons, especially hydrocarbons originating from refinery operations, such as for example atmospheric distillation unit or a fluid catalytic cracking unit (FCC), into lighter boiling hydrocracked hydrocarbons having a boiling point lower than naphthalene and lower.

U.S. Pat. No. 4,137,147 relates to a process for manufacturing ethylene and propylene from a charge having a distillation point lower than about 360 DEG C. and containing at least normal and iso-paraffins having at least 4 carbon atoms per molecule, wherein: the charge is subjected to a hydrogenolysis reaction in a hydrogenolysis zone, in the presence of a catalyst, (b) the effluents from the hydrogenolysis reaction are fed to a separation zone from which are discharged (i) from the top, methane and possibly hydrogen, (ii) a fraction consisting essentially of hydrocarbons with 2 and 3 carbon atoms per molecule, and (iii) from the bottom, a fraction consisting essentially of hydrocarbons with at least 4 carbon atoms per molecule, (c) only the fraction consisting essentially of hydrocarbons with 2 and 3 carbon atoms per molecule is fed to a steam-cracking zone, in the presence of steam, to transform at least a portion of the hydrocarbons with 2 and 3 carbon atoms per molecule to monoolefinic hydrocarbons; the fraction consisting essentially of hydrocarbons with at least 4 carbon atoms per molecule, obtained from the bottom of the separation zone, is supplied to a second hydrogenolysis zone where it is treated in the presence of a catalyst, the effluent from the second hydrogenolysis zone is supplied to a separation zone to discharge, on the one hand, hydrocarbons with at least 4 carbon atoms per molecule which are recycled at least partly to the second hydrogenolysis zone, and, on the other hand, a fraction consisting essentially of a mixture of hydrogen, methane and saturated hydrocarbons with 2 and 3 carbon atoms per molecule; a hydrogen stream and a methane stream are separated from the mixture and there is fed to the steam-cracking zone the hydrocarbons of the mixture with 2 and 3 carbon atoms, together with the fraction consisting essentially of hydrocarbons with 2 and 3 carbon atoms per molecule as recovered from the separation zone following the first hydrogenolysis zone. At the outlet of the steam-cracking zone are thus obtained, in addition to a stream of methane and hydrogen and a stream of paraffinic hydrocarbons with 2 and 3 carbon atoms per molecule, olefins with 2 and 3 carbon atoms per molecule and products with at least 4 carbon atoms per molecule.

U.S. Pat. No. 3,317,419 relates to a process for hydrorefining a hydrocarbon charge stock comprising hydrocarbons boiling above the gasoline boiling range which process comprises the steps of: (a) hydrocracking and hydrorefining said charge stock in admixture with hydrogen in a first reaction zone containing a hydrorefining catalytic composite; (b) separating the normally liquid product effluent from said first reaction zone into a first light fraction and a heavier fraction; (c) combining at least a portion of said first light fraction with a hydrocarbon mixture and reacting the resulting mixture with hydrogen at a temperature within said range in a second reaction zone containing a hydrorefining catalytic composite and maintained under less severe conversion conditions than said first zone; (d) separating the normally liquid product effluent from said second reaction zone into a second light fraction and a hydrorefined second heavy fraction; (e) combining at least a portion of said second light fraction with a hydrocarbon mixture, reacting the resulting mixture with hydrogen in a third reaction zone containing a hydrorefining catalytic composite and maintained under conditions to effect hydrogenative hydrorefining of said mixture within minimum hydrocracking; and,(f) separating the product effluent from said third reaction zone into a normally gaseous phase and a hydrorefined third heavy fraction.

GB 1,161,725 relates to process for selectively producing gasoline boiling range hydrocarbons by hydrocracking which comprises, contacting under hydrocracking conditions a heavy petroleum hydrocarbon feed with an amorphous base hydrocracking catalyst and a zeolite base hydrocracking catalyst, said contact being carried out in a series of catalyst beds wherein said amorphous base catalyst is separated from said zeolite base catalyst, recovering a normally liquid effluent from the last catalyst bed, separating a gasoline boiling range fraction from said liquid effluent, and recycling at least a portion of the liquid effluent boiling above the gasoline range to contact the amorphous base hydrocracking catalyst bed. The conditions in the first hydrocracking stage are maintained at a temperature in the range of between 550 F and 750 F and a total pressure in the range of between 1000 psig and 3000 psig, whereas the conditions in the second hydrocracking stage are similar, i.e. maintained at a temperature of between 550 F. and 750 F., and a total pressure of between 1000 psig and 2000 psig.

U.S. Pat. No. 3,360,456 relates to a process for the hydrocracking of hydrocarbons in two stages to produce gasoline with a reduced consumption of hydrogen wherein the temperature conditions in the first hydrocracking stage are higher than the temperature conditions in the second hydrocracking stage.

GB 1,020,595 relates to a process for the production of naphthalene and benzene which comprises passing a feedstock, containing alkyl-substituted aromatic hydrocarbons boiling within the range 200-600 F and comprising both alkyl benzenes and alkyl naphthalenes into a first hydrocracker at a temperature from 800 to 1100 F, a pressure from 150 to 1000 psig, or in the absence of a catalyst at a temperature from 1000 to 1100 F, a pressure from 150 to 1000 psig, subjecting the cracked product to hydrocracking in a second hydrocracker either in the presence of a catalyst at a temperature from 900 to 1200 F, a pressure from 150 to 1000 psig or in the absence of a catalyst at a temperature from 1100 to 1800 F and a pressure from 50 to 2500 psig.

U.S. Pat. No. 3,660,270 relates to a process for producing gasoline which comprises hydrocracking a petroleum distillate in a first conversion zone, separating the effluent from the first conversion zone into a light naphtha fraction, a second fraction having an initial boiling point between 180 and 280 F, and an end boiling point between about 500 to 600 F., and a third heavy fraction, hydrocracking and dehydrogenating the second fraction in a second conversion zone in the presence of a catalyst and recovering from the second conversion zone at least one naphtha product.

US patent application No 2007/112237 relates to a method of preparing aromatic hydrocarbons and liquefied petroleum gas (LPG) from a hydrocarbon mixture, comprising the following steps of: (a) introducing a hydrocarbon feedstock mixture and hydrogen into at least one reaction zone; (b) converting the hydrocarbon feedstock mixture in the presence of a catalyst to (i) a non-aromatic hydrocarbon compound which is abundant in LPG through hydrocracking and to (ii) an aromatic hydrocarbon compound which is abundant in benzene, toluene and xylene (BTX) through dealkylation/transalkylation within the reaction zone; and (c) recovering the LPG and aromatic hydrocarbon compound, respectively from the reaction products of step (b) through gas-liquid separation and distillation.

WO2008/043066 relates to a process for producing one or more middle distillate fuels, including (a) dehydrogenating/aromatizing a paraffinic naphtha stream into a composition containing olefins and aromatic hydrocarbons (b) subjecting the olefins and aromatic components to aromatic alkylation, and (c) separating the alkyl aromatics of middle distillate range.

U.S. Pat. No. 5,603,824 relates to an integrated hydroprocessing method in which hydrocracking, dewaxing and desulfurization all occur in a single, vertical two bed reactor, wherein a distillate is split into heavy and light fractions, the heavy fraction being hydrocracked and partially desulfurized in the top reactor bed, and the effluent from the top bed is then combined with the light fraction and is cascaded into the bottom reactor bed, where dewaxing for pour point reduction and further desulfurization occurs.

US patent application No 2003/221990 relates to a process for the production of light products, such as gas and naphtha, by processing kerosene in a second stage of a multi-stage hydrocracker, wherein kerosene, diesel and naphtha from other sources are included in the recycle, and subsequent hydroprocessing stages are maintained at lower pressures than the initial hydroprocessing stage.

Conventionally, crude oil is processed, via distillation, into a number of cuts such as naphtha, gas oils and residua. Each of these cuts has a number of potential uses such as for producing transportation fuels such as gasoline, diesel and kerosene or as feeds to some petrochemicals and other processing units.

Light crude oil cuts such a naphtha's and some gas oils can be used for producing light olefins and single ring aromatic compounds via processes such as steam cracking in which the hydrocarbon feed stream is evaporated and diluted with steam then exposed to a very high temperature (800° C. to 860° C.) in short residence time (<1 second) furnace (reactor) tubes. In such a process the hydrocarbon molecules in the feed are transformed into (on average) shorter molecules and molecules with lower hydrogen to carbon ratios (such as olefins) when compared to the feed molecules. This process also generates hydrogen as a useful by-product and significant quantities of lower value co-products such as methane and C9+ Aromatics and condensed aromatic species (containing two or more aromatic rings which share edges).

Typically, the heavier (or higher boiling point) aromatic rich streams, such as residua are further processed in a crude oil refinery to maximize the yields of lighter (distillable) products from the crude oil. This processing can be carried out by processes such as hydro-cracking (whereby the hydro-cracker feed is exposed to a suitable catalyst under conditions which result in some fraction of the feed molecules being broken into shorter hydrocarbon molecules with the simultaneous addition of hydrogen). Heavy refinery stream hydrocracking is typically carried out at high pressures and temperatures and thus has a high capital cost.

An aspect of such a combination of crude oil distillation and steam cracking of the lighter distillation cuts is the capital and other costs associated with the fractional distillation of crude oil. Heavier crude oil cuts (i.e. those boiling beyond ~350° C.) are relatively rich in substituted aromatic species and especially substituted condensed aromatic species (containing two or more aromatic rings which share edges) and under steam cracking conditions these materials yield substantial quantities of heavy by products such as C9+ aromatics and condensed aromatics. Hence, a consequence of the conventional combination of crude oil distillation and steam cracking is that a substantial fraction of the crude oil, for example 50% by weight, is not processed via the steam cracker as the cracking yield of valuable products from heavier cuts is not considered to be sufficiently high.

Another aspect of the conventional hydrocracking of heavy refinery streams such as residua is that this is typically carried out under compromise conditions which are chosen to achieve the desired overall conversion. As the feed streams contain a mixture of species with a range of easiness of cracking this results in some fraction of the distillable products formed by hydrocracking of relatively easily hydrocracked species being further converted under the conditions necessary to hydrocrack species more difficult to hydrocrack. This increases the hydrogen consumption and heat management difficulties associated with the process. This also increases the yield of light molecules such as methane at the expense of more valuable species.

US patent application No's 2012/0125813, US 2012/0125812 and US 2012/0125811 relate to a process for cracking a heavy hydrocarbon feed comprising a vaporization step, a distillation step, a coking step, a hydroprocessing step, and a steam cracking step. For example, US patent application No 2012/0125813 relates to a process for steam cracking a heavy hydrocarbon feed to produce ethylene, propylene, C4 olefins, pyrolysis gasoline, and other products, wherein steam cracking of hydrocarbons, i.e. a mixture of a hydrocarbon feed such as ethane, propane, naphtha, gas oil, or other hydrocarbon fractions, is a non-catalytic petrochemical process that is widely used to produce olefins such as ethylene, propylene, butenes, butadiene, and aromatics such as benzene, toluene, and xylenes.

US patent application No 2009/0050523 relates to the formation of olefins by thermal cracking in a pyrolysis furnace of liquid whole crude oil and/or condensate derived from natural gas in a manner that is integrated with a hydrocracking operation.

US patent application No 2008/0093261 relates to the formation of olefins by hydrocarbon thermal cracking in a pyrolysis furnace of liquid whole crude oil and/or condensate derived from natural gas in a manner that is integrated with a crude oil refinery.

BRIEF SUMMARY OF THE INVENTION

An object of the present invention is to provide a method for converting a high-boiling hydrocarbon feedstock into lighter boiling hydrocarbon products.

Another object of the present invention is to provide a method for producing light boiling hydrocarbon products which can be used as a feedstock for further chemical processing.

Another object of the present invention is to provide a method for converting a high-boiling hydrocarbon feedstock into a BTX aromatics fraction and an LPG fraction, wherein said LPG fraction can be used for producing light olefins.

Another object of the present invention is to provide a method for converting a high-boiling hydrocarbon feedstock into high value products, wherein the production of low value products such as methane and C9+ aromatics species is minimized.

The present invention relates to a process for converting a high-boiling hydrocarbon feedstock into lighter boiling hydrocarbon products, said lighter boiling hydrocarbon products being suitable as a feedstock for petrochemicals processes, said converting process comprising the following steps of:

feeding a heavy hydrocarbon feedstock to a cascade of hydrocracking unit(s), cracking said feedstock in a hydrocracking unit, separating said cracked feedstock into a top stream comprising a light boiling hydrocarbon fraction and a bottom stream comprising a heavy hydrocarbon fraction feeding said bottom stream of such a hydrocracking unit as a feedstock for a subsequent hydrocracking unit in said cascade of hydrocracking unit(s), wherein the process conditions in each hydrocracking unit(s) are different from each other, in which the hydrocracking conditions from the first to the subsequent hydrocracking unit(s) increase from least severe to most severe, and processing the lighter boiling hydrocarbon fractions from each hydrocracking unit(s) as a feedstock for a BTX and LPG producing unit, said BTX and LPG producing unit being a hydrocracking unit wherein the process conditions prevailing in said hydrocracking unit are different from the process conditions prevailing in any one of the hydrocracking unit(s) in the cascade of hydrocracking unit(s).

According to the present process it is preferred that the lighter boiling hydrocarbon fractions from all hydrocracking units in said cascade of hydrocracking unit(s) are hydrocarbons having a boiling point lower than naphthalene.

According to the present invention a hydrocarbon feedstock, for example crude oil, is fed to a fractional distillation column (ADU) and the material boiling at a higher temperature than 218 C (the boiling point for naphthalene) is fed to a series (or cascade) of hydrocracking process reactors with a range of (increasingly severe) operating conditions/catalysts etc. chosen to maximise the yield of material suitable for production of LPG and BTX aromatics via hydrocracking processes, such as Feed Hydrocracking (FHC) or Gasoline Hydrocracking (GHC) processes. After each step of hydrocracking the remaining heavy material (boiling point >218 C) is separated from the lighter products and only the heavier materials are fed to the next, more severe, stage of hydrocracking whilst lighter material is separated and thus not exposed to further hydrocracking. This lighter material (boiling point <218 C) is fed to a FHC or GHC process for the production of LPG and BTX aromatics. The LPG products from the GHC/FHC unit may then be converted to light olefins using steam cracking, dehydrogenation processes or a combination of these processes. The present invention will be discussed in more detail in the experimental section of this application. The term "gasoline hydrocracking unit" or "GHC reactor" will be discussed here below. The term "feed hydrocracking unit" or "FHC reactor" will be discussed here below, as well.

The present inventors optimise each step of the hydrocracking cascade (via chosen operating conditions, catalyst type and reactor design) such that the ultimate yield of desired products (hydrocarbon material with boiling point higher than methane and lower than naphthalene) is maximised and capital and associating operating costs are minimised.

The term "cascade of hydrocracking unit(s)" as used herein means a series of hydrocracking units. The hydrocracking units are separated from each other by a separation unit, i.e. a unit in which the cracked feedstock is separated into a top stream comprising a light boiling hydrocarbon fraction and a bottom stream comprising a heavy hydrocarbon fraction. And the bottom stream comprising a heavy hydrocarbon fraction of such a hydrocracking unit is a feedstock for a subsequent hydrocracking unit. Such a construction is different from a construction wherein several catalyst beds are arranged vertically wherein the effluent from one bed is cascaded into another bed, namely from the top bed into the bottom bed, since such a cascade does not apply the intermediate step of withdrawal of the complete effluent and the separation thereof into a top stream comprising a light boiling hydrocarbon fraction and a bottom stream comprising a heavy hydrocarbon fraction, wherein the bottom stream comprising a heavy hydrocarbon fraction is a feedstock for a subsequent hydrocracking unit. The separation unit herein may comprise several separation sections.

According to a preferred embodiment of the present process the lighter boiling hydrocarbon products from all hydrocracking units are hydrocarbons having a boiling point higher than methane and lower than naphthalene.

According to a preferred embodiment of the present process each hydrocracking unit in the cascade of hydrocracking unit(s) is operated under liquid phase hydrocracking conditions, and wherein the hydrocracking unit as said BTX and LPG producing unit is operated under gaseous phase hydrocracking conditions. In fact, the cascade of hydrocracking unit(s) operating under liquid phase hydrocracking conditions is placed in series, whereas the hydrocracking unit, i.e. as the BTX and LPG producing unit, operating under gaseous phase hydrocracking conditions is placed parallel with regard to the cascade of hydrocracking unit(s) operating under liquid phase hydrocracking conditions.

It is preferred to combine the lighter boiling hydrocarbon fractions from all hydrocracking units and to process this combined stream as a feedstock for said BTX and LPG producing unit, said unit being preferably a hydrocracking unit wherein the process conditions prevailing in said BTX and LPG producing unit, i.e. gaseous phase hydrocracking conditions, are different from the process conditions prevailing in any one of the cascade of hydrocracking unit(s), i.e. liquid phase hydrocracking conditions.

In another embodiment it is preferred to send the lighter boiling hydrocarbon products from all hydrocracking units first to a separation section, in which separation section a fraction comprising C5− material is separated from the lighter boiling hydrocarbon products, and the remaining part of the lighter boiling hydrocarbon products is processed as a feedstock for said BTX and LPG producing unit. In addition, it is preferred to further process said C5− material in dehydrogenation units, preferably by further pre-separating said C5− material into a stream comprising C3 and a stream comprising C4 and feeding said streams to a propane dehydrogenation unit and a butane dehydrogenation unit, respectively.

According to an embodiment it is preferred to separate the lighter portion of this stream, i.e. the lighter boiling hydrocarbon products from all hydrocracking units, and only process the heavier part through the GHC/FHC. This is because the GHC/FHC is intended to turn BTX co-boiling non-aromatic species (e.g. paraffins and olefins) into LPG species, which can be separated and used as feed to other petrochemical plants (e.g. dehydrogenation units), and pure BTX aromatics. If there are already LPG species in the lighter boiling hydrocarbon products from the hydrocracking units there is no need to process them through the GHC/FHC unit and some reasons not too (e.g. the need for a larger unit).

The exact cut point for the stream to go to the GHC/FHC is somewhat flexible as this unit can cope with LPG's in the feed and it may still be useful to include C5 species in the feed to the GHC/FHC so that these can be converted to ethane, propane and butane which can be used as feeds for the dehydrogenation units. For this reason it is preferred to include a splitter (using conventional technology such as distillation) in the feed to the GHC/FHC.

In such an embodiment three sensible alternative cut points for the lighter boiling hydrocarbon products exist. The first preferred embodiment is to process the full stream via GHC/FHC without any separation—sensible if only a small amount of LPG already exists as this will reduce the number of processing units (and thus costs) without greatly increasing the size etc. of GHC/FHC.

The second preferred embodiment concerns the separation of the lighter boiling hydrocarbon products into a C5− portion and a C6+ portion and to process the C6+ portion via GHC/FHC to make pure BTX and to convert any C6+ non-aromatics into LPG species. In parallel, process the C5− portion via some other units (not specified) for which this is a good feed.

The third preferred embodiment concerns the separation of the lighter boiling hydrocarbon products into a C4− portion (LPG) and a C5+ portion and to process the C5+ portion via GHC/FHC to make pure BTX and to convert any C5+ non-aromatics into LPG species. In parallel, process the C4− portion (potentially in combination with the LPG product from GHC/FHC) via some other units, potentially after further separation into C2, C3 and C4 species, such as ethane steam crackers and propane-butanes-dehydrogenation units.

The present process further comprises separating hydrogen from the lighter boiling hydrocarbon products and feeding the hydrogen thus separated to a hydrocracking unit in the cascade of hydrocracking unit(s), wherein the hydrogen thus separated is preferably fed to a preceding hydrocracker unit in the cascade of hydrocracking unit(s).

In another embodiment it is also preferred to feed the hydrogen thus separated to the BTX and LPG producing unit.

The hydrocarbon feedstock can be a cut from a crude oil atmospheric distillation unit (ADU), such as a bottom stream or atmospheric gas oils, products from refinery processes, such as Light Cycle Oil from an FCC unit or heavy cracked naphthas.

The present process further comprises further processing a fraction comprising LPG as produced in said LPG producing unit as a feedstock for one or more process units chosen from the group of steam cracking unit, aromatization unit, propane dehydrogenation unit, butane dehydrogenation unit and mixed propane-butane dehydrogenation unit.

In specific embodiments alkylation processes, high severity catalytic cracking (including high severity FCC), light naphtha aromatization (LNA), reforming and mild hydrocracking can be mentioned as well. The choice of the petrochemicals processes mentioned before is, inter alia, dependent on the composition of the light boiling hydrocarbon fractions. If, for example a stream mainly comprising C5 is obtained, the pentane dehydrogenation unit would be preferred. In addition, such a stream mainly comprising C5 can be sent to high severity catalytic cracking (including high severity FCC) for making propylene and ethylene as well. If, for example a stream mainly comprising C6 is obtained, a process such as light naphtha aromatization (LNA), reforming and mild hydrocracking, would be preferred.

The present cascade of hydrocracking units comprises preferably at least two hydrocracking units, wherein said hydrocracking units are preferably preceded by a hydrotreating unit, wherein the bottom stream of said hydrotreating unit is used as a feedstock for said first hydrocracking unit, especially that the temperature prevailing in said hydrotreating unit is higher than in said first hydrocracking unit.

In addition it is preferred that the temperature in the first hydrocracking unit is lower than the temperature in the second hydrocracking unit.

In addition it is also preferred that the particle size of the catalyst present in the cascade of hydrocracking units decreases from the first hydrocracking unit to the subsequent hydrocracking unit(s).

According to a preferred embodiment the temperature in the cascade of hydrocracking units increases, wherein the temperature prevailing in said second hydrocracking unit is higher than in said hydrotreating unit.

The reactor type design of the present hydrocracking unit(s) is chosen from the group of the fixed bed type, ebulated bed reactor type and the slurry phase type. This may involve a series of dissimilar processes such as first as fixed bed hydrotreater, followed by a fixed bed hydrocracker, followed by an ebulated bed hydro-cracker, optionally followed by a slurry hydrocracker. Thus, the reactor type design of said hydrotreating unit is of the fixed bed type, the reactor type design of said first hydrocracking unit may be of the fixed bed or ebulated bed reactor type and the reactor type design of said second hydrocracking unit may be of the ebulatted bed reactor or the slurry phase type.

In the present process it is preferred to recycle the bottom stream of the final hydrocracking unit to the inlet of said final hydrocracking unit.

The process conditions prevailing in the BTX and LPG producing unit are different from the process conditions prevailing in any one of the cascade of hydrocracking unit(s).

The present invention further relates to the use of hydrocarbons having a boiling point lower than naphthalene and produced in a cascade of hydrocracking unit(s) as a feedstock for a BTX and LPG producing unit.

The afore mentioned use further comprises the recovering of hydrogen from the effluent(s) of said BTX and LPG producing unit and recycling said hydrogen thus recovered to the inlet of said BTX and LPG producing unit.

The present process thus preferably comprises feeding the stream comprising C5+ to a second hydrocracking unit. An extra advantage is the possibility to integrate the pre-heating of the C5+ feed to the second hydrocracking unit coming from the first hydrocracking unit with the hot effluent.

As used herein, the term "gasoline hydrocracking unit" or "GHC" refers to an unit for performing a hydrocracking process suitable for converting a complex hydrocarbon feed that is relatively rich in aromatic hydrocarbon compounds—such as refinery unit-derived light-distillate including, but not limited to, reformer gasoline, FCC gasoline and pyrolysis gasoline (pygas)—to LPG and BTX, wherein the process is optimized to keep one aromatic ring intact of the aromatics comprised in the GHC feed stream, but to remove most of the side-chains from the aromatic ring. Accordingly, the main product produced by gasoline hydrocracking is BTX and the process can be optimized to provide chemicals-grade BTX. Preferably, the hydrocarbon feed that is subjected to gasoline hydrocracking comprises refinery unit-derived light-distillate. More preferably, the hydrocarbon feed that is subjected to gasoline hydrocracking preferably does not comprise more than 1 wt. –% of hydrocarbons having more than one aromatic ring. Preferably, the gasoline hydrocracking conditions include a temperature of 300-580° C., more preferably of 450-580° C. and even more preferably of 470-550° C. Lower temperatures must be avoided since hydrogenation of the aromatic ring becomes favourable. However, in case the catalyst comprises a further element that reduces the hydrogenation activity of the catalyst, such as tin, lead or bismuth, lower temperatures may be selected for gasoline hydrocracking; see e.g. WO 02/44306 A1 and WO 2007/055488. In case the reaction temperature is too high, the yield of LPG's (especially propane and butanes) declines and the yield of methane rises. As the catalyst activity may decline over the lifetime of the catalyst, it is advantageous to increase the reactor temperature gradually over the life time of the catalyst to maintain the hydrocracking conversion rate. This means that the optimum temperature at the start of an operating cycle preferably is at the lower end of the hydrocracking temperature range. The optimum reactor temperature will rise as the catalyst deactivates so that at the end of a cycle (shortly before the catalyst is replaced or regenerated) the temperature preferably is selected at the higher end of the hydrocracking temperature range. Preferably, the gasoline hydrocracking of a hydrocarbon feed stream is performed at a pressure of 0.3-5 MPa gauge, more preferably at a pressure of 0.6-3 MPa gauge, particularly preferably at a pressure of 1-2 MPa gauge and most preferably at a pressure of 1.2-1.6 MPa gauge. By increasing reactor pressure, conversion of C5+ non-aromatics can be increased, but this also increases the yield of methane and the hydrogenation of aromatic rings to cyclohexane species which can be cracked to LPG species. This results in a reduction in aromatic yield as the pressure is increased and, as some cyclohexane and its isomer methylcyclopentane, are not fully hydrocracked, there is an optimum in the purity of the resultant benzene at a pressure of 1.2-1.6 MPa.

Preferably, gasoline hydrocracking of a hydrocarbon feed stream is performed at a Weight Hourly Space Velocity (WHSV) of 0.1-20 h-1, more preferably at a Weight Hourly Space Velocity of 0.2-10 h-1 and most preferably at a Weight Hourly Space Velocity of 0.4-5 h-1. When the space velocity is too high, not all BTX co-boiling paraffin components are hydrocracked, so it will not be possible to achieve BTX specification by simple distillation of the reactor product. At too low space velocity the yield of methane rises at the expense of propane and butane. By selecting the optimal Weight Hourly Space Velocity, it was surprisingly found that sufficiently complete reaction of the benzene co-boilers is achieved to produce on spec BTX without the need for a liquid recycle.

Accordingly, preferred gasoline hydrocracking conditions thus include a temperature of 450-580° C., a pressure of 0.3-5 MPa gauge and a Weight Hourly Space Velocity of 0.1-20 h-1. More preferred gasoline hydrocracking conditions include a temperature of 470-550° C., a pressure of 0.6-3 MPa gauge and a Weight Hourly Space Velocity of 0.2-10 h-1. Particularly preferred gasoline hydrocracking conditions include a temperature of 470-550° C., a pressure of 1-2 MPa gauge and a Weight Hourly Space Velocity of 0.4-5 h-1.

As used herein, the term "feed hydrocracking unit" or "FHC" refers to a unit for performing a hydrocracking process suitable for converting a complex hydrocarbon feed that is relatively rich in naphthenic and paraffinic hydrocarbon compounds—such as straight run cuts including, but not limited to, naphtha—to LPG and alkanes. Preferably, the hydrocarbon feed that is subject to feed hydrocracking comprises naphtha. Accordingly, the main product produced by feed hydrocracking is LPG that is to be converted into olefins (i.e. to be used as a feed for the conversion of alkanes to olefins). The FHC process may be optimized to keep one aromatic ring intact of the aromatics comprised in the FHC feed stream, but to remove most of the side-chains from the aromatic ring. In such a case, the process conditions to be employed for FHC are comparable to the process conditions to be used in the GHC process as described herein above. Alternatively, the FHC process can be optimized to open the aromatic ring of the aromatic hydrocarbons comprised in the FHC feed stream. This can be achieved by modifying the GHC process as described herein by increasing the hydrogenation activity of the catalyst, optionally in combination with selecting a lower process temperature, optionally in combination with a reduced space velocity. In such a case, preferred feed hydrocracking conditions thus include a temperature of 300-550° C., a pressure of 300-5000 kPa gauge and a Weight Hourly Space Velocity of 0.1-20 h-1. More preferred feed hydrocracking conditions include a temperature of 300-450° C., a pressure of 300-5000 kPa gauge and a Weight Hourly Space Velocity of 0.1-10 h-1. Even more preferred FHC conditions optimized to the ring-opening of aromatic hydrocarbons include a temperature of 300-400° C., a pressure of 600-3000 kPa gauge and a Weight Hourly Space Velocity of 0.2-5 h-1.

As used herein, the term "C# hydrocarbons" or "C#", wherein "#" is a positive integer, is meant to describe all hydrocarbons having # carbon atoms. Moreover, the term "C#+ hydrocarbons" or "C#+" is meant to describe all hydrocarbon molecules having # or more carbon atoms. Accordingly, the term "C5+ hydrocarbons" or "C5+" is meant to describe a mixture of hydrocarbons having 5 or more carbon atoms. The term "C5+ alkanes" accordingly relates to alkanes having 5 or more carbon atoms. Accordingly, the term "C# minus hydrocarbons" or "C# minus" is meant to describe a mixture of hydrocarbons having # or less carbon atoms and including hydrogen. For example, the term "C2–" or "C2 minus" relates to a mixture of ethane, ethylene, acetylene, methane and hydrogen. Finally, the term "C4 mix" is meant to describe a mixture of butanes, butenes and butadiene, i.e. n-butane, i-butane, 1-butene, cis- and trans-2-butene, i-butene and butadiene.

The term "olefin" is used herein having its well-established meaning. Accordingly, olefin relates to an unsaturated hydrocarbon compound containing at least one carbon-carbon double bond. Preferably, the term "olefins" relates to a mixture comprising two or more of ethylene, propylene, butadiene, butylene-1, isobutylene, isoprene and cyclopentadiene.

The term "LPG" as used herein refers to the well-established acronym for the term "liquefied petroleum gas". LPG generally consists of a blend of C3-C4 hydrocarbons i.e. a mixture of C3 and C4 hydrocarbons.

The one of the petrochemical products produced in the process of the present invention is BTX. The term "BTX" as used herein relates to a mixture of benzene, toluene and xylenes. Preferably, the product produced in the process of the present invention comprises further useful aromatic hydrocarbons such as ethyl benzene. Accordingly, the present invention preferably provides a process for producing a mixture of benzene, toluene xylenes and ethyl benzene ("BTXE"). The product as produced may be a physical mixture of the different aromatic hydrocarbons or may be directly subjected to further separation, e.g. by distillation, to provide different purified product streams. Such purified product stream may include a benzene product stream, a toluene product stream, a xylene product stream and/or an ethyl benzene product stream.

BRIEF DESCRIPTION OF THE DRAWINGS

The invention will be described in further detail below and in conjunction with the attached drawings in which the same or similar elements are referred to by the same number.

DETAILED DESCRIPTION OF THE INVENTION

Figure 1:
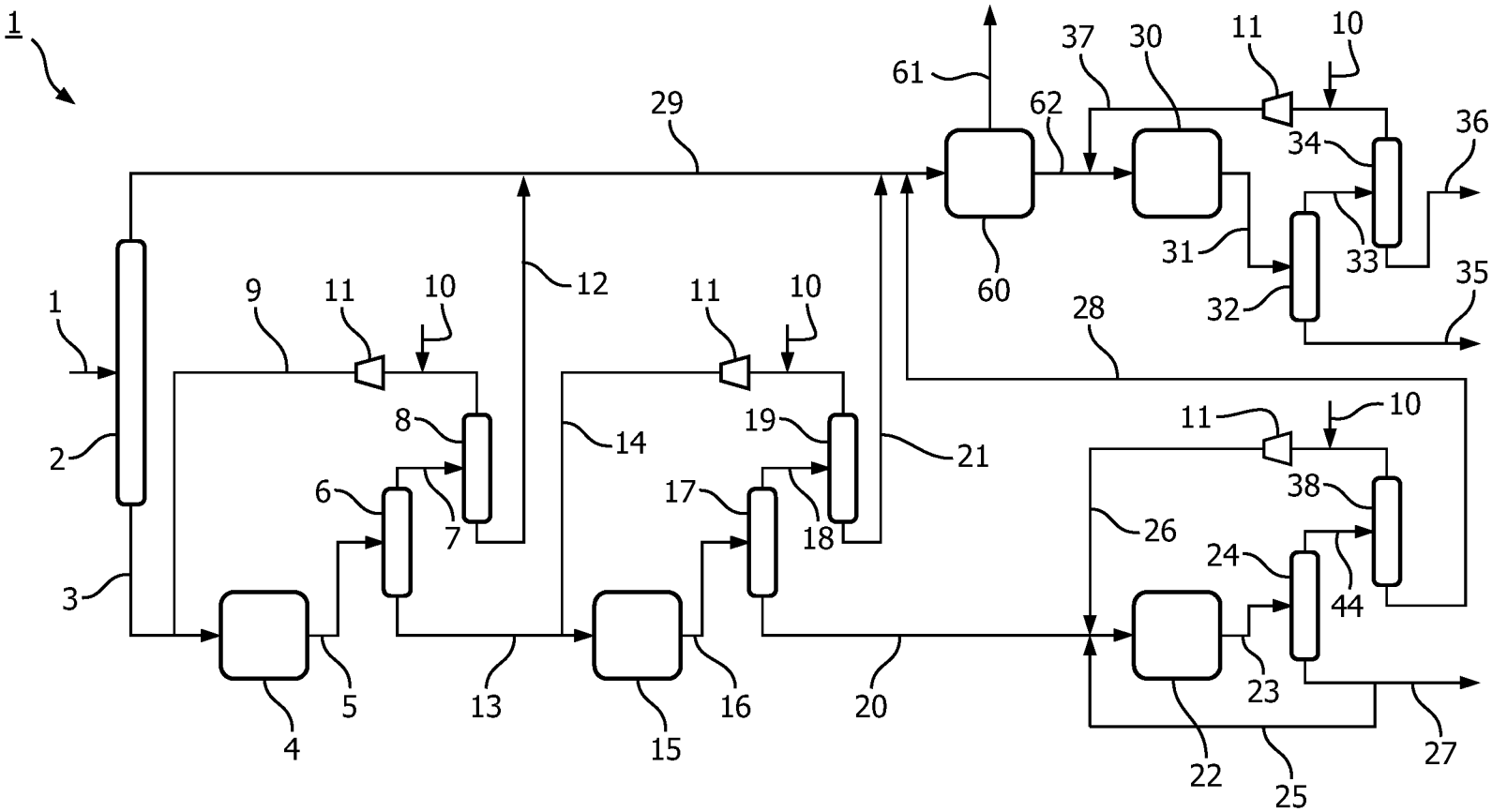
FIG. 1 is a schematic illustration of an embodiment of the process of the invention.

Referring now to the process and apparatus 1 schematically depicted in FIG. 1, there is shown crude oil feed 1, an atmospheric distillation unit 2 for separating the crude oil into stream 29, comprising hydrocarbons having a boiling point lower than naphthalene. Bottom stream 3 leaving distillation unit 2 is fed to a hydro processing unit 4, for example a hydro treating unit, wherein the thus treated hydrocarbons 5 are sent to a separation unit 6 producing a gaseous stream 7 and a bottom stream 13 comprising hydrocarbons having a boiling point of naphthalene and higher. Stream 7 is further separated in separation unit 8 into a stream 9 comprising hydrogen and a bottom stream 12 comprising hydrocarbons having a boiling point lower than naphthalene. Stream 13 is fed into a hydrocracking unit 15 and its effluent 16 is sent to a separation unit 17 producing gaseous stream 18 and a bottom stream 20 comprising hydrocarbons having a boiling point of naphthalene and higher. Stream 18 is further separated in separation unit 19 into stream 14, comprising hydrogen and a stream 21, comprising hydrocarbons having a boiling point lower than naphthalene. Hydrogen make up is indicated with reference number 10. The effluent 20 from separation unit 17 is sent to a further hydrocracking unit 22 and its effluent 23 is sent to a separation unit 24 producing a top stream 44 and a bottom stream 27. Top stream 44 is further separated in separation unit 38 into stream 26 comprising hydrogen and a bottom stream 28 comprising hydrocarbons having a boiling point lower than naphthalene. The hydrogen containing stream leaving separation unit 38 is sent to compressor 11 and returned to the inlet of hydrocracking unit 22. The same recycle of hydrogen applies for streams 9, 14. The top stream coming from distillation unit 2 and streams 12, 21 and 28 are combined as a stream 29, which stream 29 is directly sent to a hydrocracker 30. Processing the full stream 29 via unit 30 without any separation is sensible if only a small amount of LPG already exists in stream 29 as this will reduce the number of processing units (and thus costs) without greatly increasing the size etc. of hydrocracker unit 30.

According to a preferred embodiment it is also possible to separate stream 29 in separation unit 60 into a C5− portion (stream 61) and a C6+ portion (stream 62), and to process the C6+ portion via unit 30 to make pure BTX and to convert any C6+ non-aromatics into LPG species. In parallel, process the C5− portion via some other units (not specified) for which this is a good feed.

According to another preferred embodiment it is also possible to separate stream 29 into a C4− portion (LPG) (stream 61), and a C5+ portion (stream 62), and to process the C5+ portion (stream 62), via unit 30 to make pure BTX and to convert any C5+ non-aromatics into LPG species. In parallel, process the C4− portion (stream 61, potentially in combination with the LPG product from unit 30, i.e. stream 36, via some other units e.g. propane/butane dehydrogenation units.

Effluent 31 from hydrocracking unit 30 is sent to a separation unit 32 producing a top stream 33 and a bottom stream 35, mainly comprising BTX. Top stream 33 is further separated in separation unit 34 into stream 36, comprising LPG, and a top stream 37, comprising hydrogen. Stream 37 is recycled to the inlet of hydrocracking unit 30.

Figure 2:
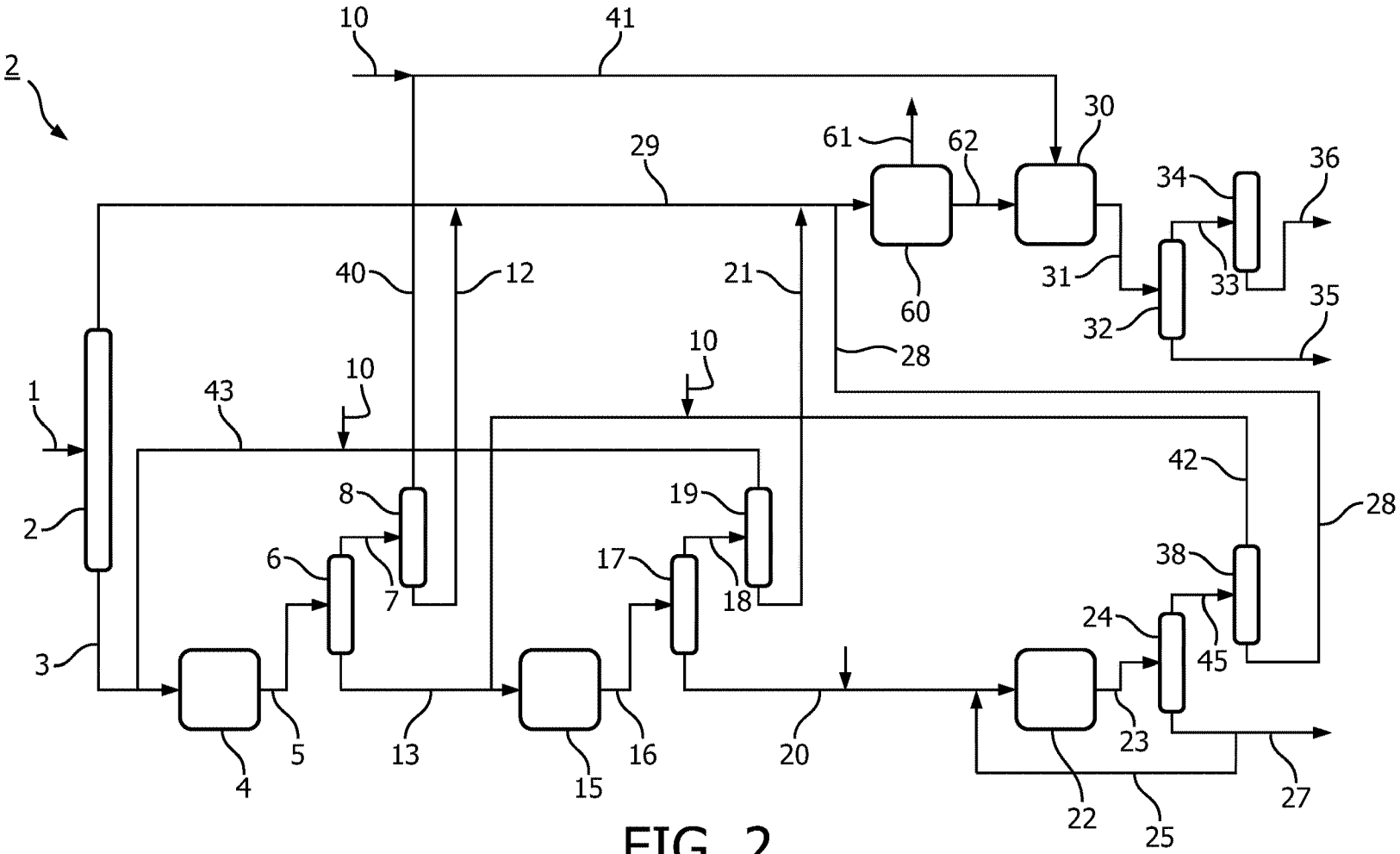
FIG. 2 is a schematic illustration of another embodiment of the process of the invention.

According to FIG. 2 the process and apparatus are identified with reference number 2, wherein crude oil 1 is sent to a distillation unit 2 and separated into a top stream 29 and a bottom stream 3. Bottom stream 3 is sent to a hydrocracking unit 4, especially a hydro treating unit, producing effluent 5. Effluent 5 is sent to a separation unit 6 producing a top stream 7 and a bottom stream 13, comprising hydrocarbons having a boiling point of naphthalene and higher. Top stream 7 is further separated in separation unit 8 into top stream 40, mainly comprising hydrogen and bottom stream 12, comprising hydrocarbons having a boiling point lower than naphthalene. Stream 13 is sent to a first hydrocracking unit 15 producing effluent stream 16. Effluent stream 16 is sent to a separation unit 17 producing a top stream 18 and a bottom stream 20. Stream 18 is further separated in separation unit 19 producing stream 43, comprising hydrogen. Stream 43 is in FIG. 2 recycled to the inlet of hydrocracking unit 4. The bottom stream 21 of separation unit 19 is combined with top stream 29 from unit 2 and sent to hydrocracking unit 30.

Processing the full stream 29 via unit 30 without any separation is sensible if only a small amount of LPG already exists in stream 29 as this will reduce the number of processing units (and thus costs) without greatly increasing the size etc. of hydrocracker unit 30.

According to a preferred embodiment it is also possible to separate stream 29, before entering unit 30, into a C5− portion (stream 61), and a C6+ portion (stream 62), and to process the C6+ portion (stream 62), via unit 30 to make pure BTX and to convert any C6+ non-aromatics into LPG species. In parallel, process the C5− portion (stream 61) via some other units (not specified) for which this is a good feed.

According to another preferred embodiment it is also possible to separate stream 29, before entering unit 30, into a C4− portion (stream 61) (LPG) and a C5+ portion (stream 62) and to process the C5+ portion (stream 62) via unit 30 to make pure BTX and to convert any C5+ non-aromatics into LPG species. In parallel, process the C4− portion (stream 62, potentially in combination with the LPG product from unit 30, i.e. stream 36) via some other units e.g. (propane/butane dehydrogenation units).

Bottom stream 20 from separation unit 17 is sent to a second hydrocracking unit 22 producing effluent 23. Effluent 23 is further separated in separation column 24 into a top stream 45 and a bottom stream 27, qualified as heavy pitch. A portion of stream 27 is recycled as stream 25 to the inlet of second hydrocracking unit 22. In separation column 38 top stream 45 is further separated into top stream 42, mainly comprising hydrogen, and bottom stream 28, mainly comprising hydrocarbons having a boiling point less than the boiling point of naphthalene. The hydrogen containing stream 42 is recycled to the inlet of hydrocracking unit 15. Top stream 40 leaving separation column 8 is combined with hydrogen make up 10 and forms a stream 41 as an inlet stream for hydrocracking unit 30. Effluent 31 coming from hydrocracking unit 30 is further separated in separation unit 32 into a top stream 33 and a bottom stream 35, comprising BTX. Top stream 33 is further separated in separation column 34 into stream 36, mainly comprising LPG.

According to another embodiment it is preferred to redesign units 30, 32 and 33 to convert the aromatic and naphthenic the species in stream 29 (including the material from streams 12, 21 and 28) into LPG. This embodiment can be identified as an "indirect" route as each hydrocracker unit in the cascade makes some LPG material but also other species which are converted to LPG in a second hydrocracker. This would mean operating hydrocracking unit 30 at a lower temperature and higher hydrogen partial pressure. There is a change in the distillation section of this facility as one could either eliminate column 32 (as there is no BTX product stream 35) or use column 32 as a way of recycling material heavier than LPG (stream 35) back to the reactor (unit 30). In this way of operating one could continue to operate the reactors and separation systems for the other hydrocrackers as previously described.

The invention claimed is:

1. A process for converting a high-boiling hydrocarbon feedstock into lighter boiling hydrocarbon products, said lighter boiling hydrocarbon products being suitable as a feedstock for petrochemicals processes, said converting process comprising the steps of:

feeding a heavy hydrocarbon feedstock to a cascade of hydrocracking units, wherein the cascade of hydrocracking units comprises at least two hydrocracking units;

cracking said heavy hydrocarbon feedstock in one of the hydrocracking units to produce a cracked feedstock;

separating said cracked feedstock into a top stream comprising a light boiling hydrocarbon fraction and a bottom stream comprising a heavy hydrocarbon fraction;

feeding the entire said bottom stream of such a hydrocracking unit as a feedstock for a subsequent hydrocracking unit in said cascade of hydrocracking units, wherein the process conditions in each hydrocracking unit are different from each other, in which the temperature from the first to the subsequent hydrocracking units increases;

processing lighter boiling hydrocarbon fractions from each hydrocracking unit as a feedstock for a BTX and LPG producing unit, said BTX and LPG producing unit being a hydrocracking unit wherein the process conditions prevailing in said hydrocracking unit are different from the process conditions prevailing in any one of the hydrocracking units in the cascade of hydrocracking units;

wherein the lighter boiling hydrocarbon fractions from all hydrocracking units in said cascade of hydrocracking units are hydrocarbons having a boiling point lower than naphthalene; and wherein each hydrocracking unit in said cascade of hydrocracking units is operated under liquid phase hydrocracking conditions, and wherein said hydrocracking unit as said BTX and LPG producing unit is operated under gaseous phase hydrocracking conditions.

2. The process according to claim 1, wherein the lighter boiling hydrocarbon fractions from said hydrocracking unit are sent to a separation section, in which section a fraction comprising C5− material is separated from said lighter boiling hydrocarbon fractions, and the remaining part of said lighter boiling hydrocarbon fractions is processed as a feedstock for said BTX and LPG producing unit.

3. The process according claim 2, further comprising processing said C5− material in dehydrogenation units by further pre-separating said C5− material into a stream comprising C3 and a stream comprising C4 and feeding said streams to a propane dehydrogenation unit and a butane dehydrogenation unit, respectively.

4. The process according to claim 1, further comprising separating hydrogen from said lighter boiling hydrocarbon fractions and feeding said hydrogen thus separated to at least one of a hydrocracking unit in said cascade of hydrocracking unit, a preceding hydrocracker unit in said cascade of hydrocracking unit, and to said BTX and LPG producing unit.

5. The process according to claim 1, further comprising processing a fraction comprising LPG as produced in said LPG producing unit as a feedstock for one or more process units including at least one of a steam cracking unit, an aromatization unit, a propane dehydrogenation unit, a butane dehydrogenation unit and a mixed propane-butane dehydrogenation unit.

6. The process according to claim 1, wherein said hydrocracking units are preceded by a hydrotreating unit, wherein the bottom stream of said hydrotreating unit is used as a feedstock for said first hydrocracking unit, and the temperature prevailing in said hydrotreating unit is higher than in said first hydrocracking unit.

7. The process according to claim 1, wherein the temperature in the first hydrocracking unit is lower than the temperature in the second hydrocracking unit, and wherein particle size of the catalyst present in the cascade of hydrocracking units decreases from the first hydrocracking unit to the subsequent hydrocracking unit.

8. The process according to claim 6, wherein the temperature in the cascade of hydrocracking units increases, and wherein the temperature prevailing in said second hydrocracking unit is higher than in said hydrotreating unit.

9. The process according to claim 1, wherein the reactor type design of the hydrocracking unit includes at least one of a fixed bed type, ebulated bed reactor type and a slurry phase type, wherein the reactor type design of said hydrotreating unit is of the fixed bed type, wherein the reactor type design of said first hydrocracking unit is of the ebulated bed reactor type, and wherein the reactor type design of said second hydrocracking unit is of the slurry phase type.

10. A process for converting a high-boiling hydrocarbon feedstock into lighter boiling hydrocarbon products, said lighter boiling hydrocarbon products being suitable as a feedstock for petrochemicals processes, said converting process comprising the steps of:

feeding a heavy hydrocarbon feedstock to a cascade of hydrocracking units, wherein the cascade of hydrocracking units comprises at least two hydrocracking units;

cracking said heavy hydrocarbon feedstock in one of the hydrocracking unit to produce a cracked feedstock;

separating said cracked feedstock into a top stream comprising a light boiling hydrocarbon fraction and a bottom stream comprising a heavy hydrocarbon fraction;

feeding the entire said bottom stream of such a hydrocracking unit as a feedstock for a subsequent hydrocracking unit in said cascade of hydrocracking units, said bottom stream of such a hydrocracking unit as a feedstock for a subsequent hydrocracking unit in said cascade of hydrocracking units, wherein the process conditions in each hydrocracking unit are different from each other, in which the temperature from the first to the subsequent hydrocracking units increases;

processing lighter boiling hydrocarbon fractions from each hydrocracking unit as a feedstock for a BTX and LPG producing unit, said BTX and LPG producing unit being a hydrocracking unit wherein the process conditions prevailing in said hydrocracking unit are different from the process conditions prevailing in any one of the hydrocracking units in the cascade of hydrocracking units, and wherein the lighter boiling hydrocarbon fractions from all hydrocracking units in said cascade of hydrocracking units are hydrocarbons having a boiling point lower than naphthalene.

11. A process for converting a high-boiling hydrocarbon feedstock into lighter boiling hydrocarbon products, said lighter boiling hydrocarbon products being suitable as a feedstock for petrochemicals processes, said converting process comprising the steps of:

feeding a heavy hydrocarbon feedstock to a cascade of hydrocracking units, wherein the cascade of hydrocracking units comprises at least two hydrocracking units;

cracking said heavy hydrocarbon feedstock in one of the hydrocracking unit to produce a cracked feedstock;

separating said cracked feedstock into a top stream comprising a light boiling hydrocarbon fraction and a bottom stream comprising a heavy hydrocarbon fraction;

feeding said bottom stream of such a hydrocracking unit as a feedstock directly to a subsequent hydrocracking unit in said cascade of hydrocracking units, wherein the process conditions in each hydrocracking unit is different from each other, in which the temperature from the first to the subsequent hydrocracking units increases;

processing lighter boiling hydrocarbon fractions from each hydrocracking unit as a feedstock for a BTX and LPG producing unit, said BTX and LPG producing unit being a hydrocracking unit wherein the process conditions prevailing in said hydrocracking unit are different from the process conditions prevailing in any one of the hydrocracking units in the cascade of hydrocracking units.

* * * * *